United States Patent [19]

Hosooka

[11] 3,992,817

[45] Nov. 23, 1976

[54] OUTER FRAME FOR DUAL SASH WINDOW ASSEMBLY

[75] Inventor: Shuichi Hosooka, Namerikawa, Japan

[73] Assignee: Yoshida Kogyo Kabushiki Kaisha, Japan

[22] Filed: Feb. 12, 1975

[21] Appl. No.: 549,424

[30] Foreign Application Priority Data

Feb. 18, 1974 Japan ..... 49-19770[U]

[52] U.S. Cl. ..... 49/406; 49/453

[51] Int. Cl.[2] ..... E05D 15/08

[58] Field of Search ..... 49/406, 453

[56] References Cited

UNITED STATES PATENTS

| | | | |
|---|---|---|---|
| 2,568,995 | 9/1951 | Brenneman | 49/406 |
| 3,304,658 | 2/1967 | Kreger | 49/406 X |
| 3,305,973 | 2/1967 | Bohn | 49/453 X |
| 3,810,332 | 5/1974 | Grossman | 49/453 X |

*Primary Examiner*—Kenneth Downey

*Attorney, Agent, or Firm*—Bucknam and Archer

[57] ABSTRACT

A window assembly has a pair of sashes slidable along respective rails formed in parallel spaced relationship on each of the header and sill of an outer frame. A windtight sealing strip of generally arcuate shape is installed in a prescribed position on a horizontal surface between the bottom edges of the sill rails to prevent the intrusion of the wind into the room from under the meeting portions of the two sashes. The sealing strip is made of resilient material and has one end immovably secured against the horizontal surface and the opposite end held in slidable contact therewith. The sashes are installable into, and removable from, the outer frame from inside the room without the need for moving the sealing strip away from its prescribed position.

2 Claims, 4 Drawing Figures

OUTER FRAME FOR DUAL SASH WINDOW ASSEMBLY

BACKGROUND OF THE INVENTION

This invention relates generally to window constructions, and in particular to a window assembly which has a pair of sashes mounted in a generally rectangular outer frame for relative horizontal movement and which is intended for installation in a rough opening of a building wall such as, typically, the so-called curtain wall. The invention is still more particularly directed to the improved construction of the outer frame for such dual sash window assembly including means for windtightly sealing or filling the gap between the sill of the outer frame and the meeting or lapping portions of the two sashes.

Dual sash window assemblies are often employed with curtain walling which has decorative uprights on the external surface extending along the meeting portions of the window sashes. In such cases the sashes must be installed into or removed from the outer frame only from inside the room. Perhaps the simplest way of meeting this requirement is to increase the depth of downwardly opening grooves in the header of the outer frame. However, this measure is objectionable in that it necessitates too much increase in the dimension *a* (see FIG. 2 of the accompanying drawings) of the header. A decrease in the dimension *b* (FIG. 2) of the sill of the outer frame is also undesirable because then the window would not be sufficiently impervious to driving rains.

It has also been proposed to increase the height of a pair of parallel spaced rails on the sill of the outer frame in order that the sashes may be manipulated into and out of the outer frame from inside the room by taking advantage of the deep spacing between the sill rails. According to this proposal, however, the usual windtight sealing means installed between the sill rails must be manually moved away from and back to its predetermined position when the sashes are installed into the outer frame.

SUMMARY OF THE INVENTION

In view of the listed inconveniences of the prior art, it is an object of this invention to provide a dual sash window assembly including a pair of horizontally movable sashes which are easily installable into, and removable from, an outer frame from inside the room.

Another object of the invention is to provide a dual sash window assembly in which the above recited object is accomplished without sacrificing the desired weathertightness of the window.

A further object of the invention is to provide a dual sash window assembly including windtight sealing means which need not be moved away from and back to a prescribed position on the sill of the outer frame for the installation or removal of the sashes into or out of the outer frame.

With all these and other objects in view this invention provides a dual sash window assembly including a pair of sashes independently movable along respective horizontal rails formed in parallel spaced relationship on each of the header and sill of a generally rectangular outer frame. A horizontal surface is formed between and extends along the bottom edges of the pair of rails standing uprightly on the sill. A windtight sealing strip of arcuate shape, designed to prevent the intrusion of the wind into the room from under the meeting or lapping portions of the two sashes when the same are in their closed positions in the outer frame, is installed in a prescribed position on the horizontal surface. The sealing strip is made of resilient material and has one end immovably secured against the flat surface and the opposite end held in slidable contact therewith. Normally, therefore, the sealing strip generally bulges upwardly for slidable contact with the bottom edges of the sashes. Thus, by making the distance between the horizontal surface and the bottom edges of the header only slightly greater than the height of each sash, the sash can be easily manipulated into and out of the outer frame from inside the room, by temporarily dropping its bottom edge onto the horizontal surface between the sill rails. The windtight sealing strip is pressed flat against the horizontal surface when the sash is dropped between the sill rails, but automatically regains its initial shape when the sash is raised away from the horizontal surface.

The features which are believed to be novel and characteristic of this invention are set forth in particular in the appended claims. The invention itself, however, both as to its organization and the functions of its various parts, together with the further objects and advantages thereof, will become apparent in the course of the following descriptions which is to be read in connection with the accompanying drawings in which like reference characters refer to like parts throughout the several views.

DESCRIPTION OF THE PREFERRED EMBODIMENT

Figure 1:
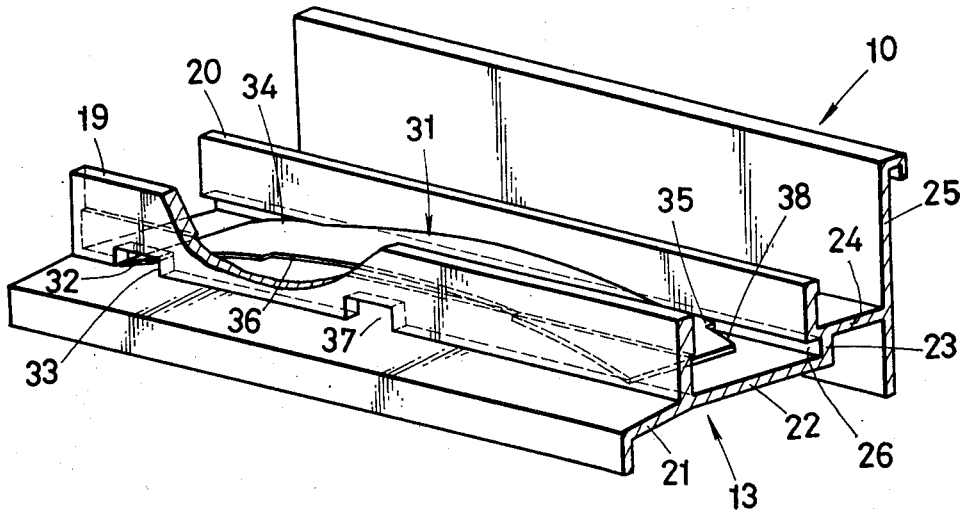
FIG. 1 is a fragmentary, partly broken away perspective view showing the sill of the outer frame, as well as a windtight sealing strip mounted in position thereon, of a dual sash window assembly incorporating the novel concepts of this invention.
Figure 4:
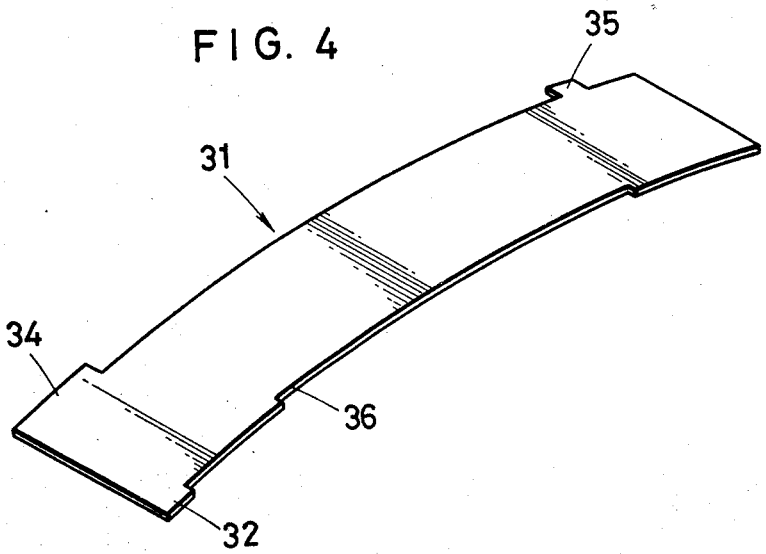
FIG. 4 is a perspective detail view of the windtight sealing strip.
Figure 2:
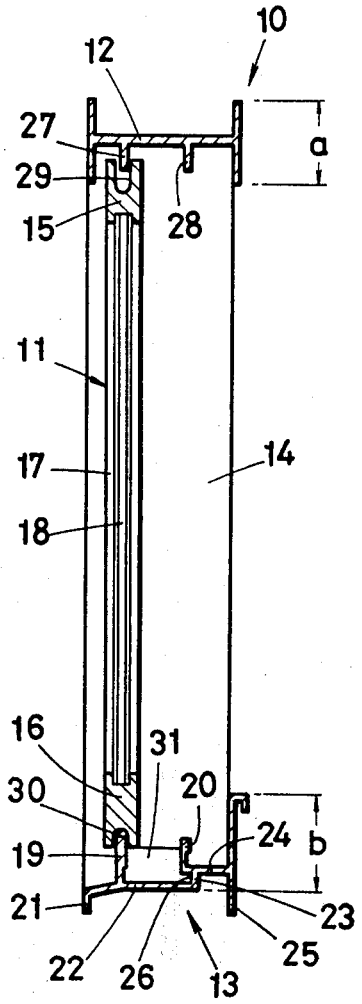
FIGS. 2 and 3 are vertical sectional views of the dual sash window assembly which are both explanatory of the way the sashes are manipulated into and out of the outer frame.
Figure 3:
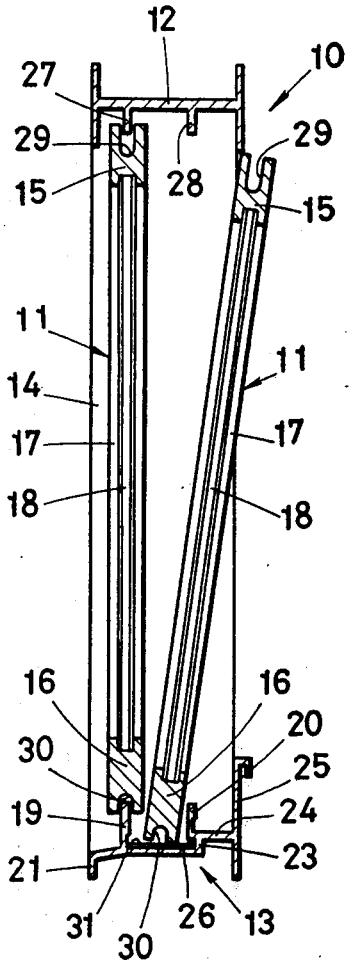

The dual sash window assembly shown in FIGS. 1, 2 and 3 broadly comprises a generally rectangular outer frame 10 and a pair of sashes 11 of substantially identical make which are to be mounted within the outer frame for relative horizontal sliding movement. The outer frame 10, which is intended to be rigidly set in the usual window-receiving opening of a wall, consists essentially of a header 12, a sill 13, and jambs 14, only one of the jambs being seeable in FIGS. 2 and 3.

Each sash 11 has an inner frame consisting of a top horizontal member 15, a bottom horizontal member 16, and side vertical members 17, only one of the side vertical members of each sash being seeable in FIGS. 2 and 3. The inner frame of each sash 11 has set within its constituent members 15, 16 and 17 of generally rectangular arrangement a panel or pane of glass 18 or other suitable material.

Referring more specifically to FIG. 1, the sill 13 has upstanding exterior and interior rails 19 and 20 extending the full length thereof in parallel, relatively closely spaced relationship. A recumbent L-shaped flange 21 projecting outwardly (toward the left as viewed in FIGS. 2 or 3) from the bottom edge of the exterior sill rail 19 may be slightly angled downwardly, as will be seen also from FIGS. 2 and 3. A horizontal framing member 22 is formed between the exterior and interior sill rails 19 and 20. The inward edge of the framing member 22 is connected via a web 23 to another framing member 24 connecting the interior sill rail 20 to an upstanding flange 25. It will be seen that the web 23 is set inwardly with respect to the interior sill rail 20 so that a groove 26 opening toward the exterior sill rail 19 is formed along the bottom edge of the interior sill rail.

As illustrated in FIGS. 2 and 3, the header 12 of the outer frame 10 also has exterior and interior rails 27 and 28 projecting downwardly therefrom in vertical register with the respective exterior and interior sill rails 19 and 20. The exterior and interior header rails 27 and 28, of course, extend the full length of the header 12. The top and bottom horizontal members 15 and 16 of each sash 11 are grooved longitudinally at 29 and 30 to slidably engage the exterior header and sill rails 27 and 19, or the interior header and sill rails 28 and 20, respectively. It is important to note that the distance between the horizontal top surface of the framing member 22 of the sill 13 and the bottom edge of the header 12 is only slightly greater than the height of each sash 11.

Referring again to FIG. 1, a windtight sealing strip 31 of plastics, metal or like suitably resilient material is installed in a prescribed position between the exterior and interior sill rails 19 and 20. The windtight sealing strip 31 is intended to prevent the intrusion of the wind into the room from under the meeting or lapping portions of the two sashes 11.

As illustrated in greater detail in FIG. 3, the windtight sealing strip 31 is of generally arcuate configuration and is sufficiently wide to fit neatly between the exterior and interior sill rails 19 and 20. A first lateral projection 32 is formed at one end of the sealing strip 31 so as to be engaged in an opening 33, FIG. 1, formed at or adjacent the bottom edge of the exterior sill rail 19. A second lateral projection 34 is formed at the said one end of the sealing strip so as to be received in the groove 26 formed along the bottom edge of the interior sill rail 20. The sealing strip 31 has still a third lateral projection 35, located on the same side as the projection 34, adjacent its opposite end. This projection 35 is considerably less than the projection 34 in its dimension in the longitudinal direction of the sealing strip 31 and is adapted to be slidably received in the groove 26. An indentation 36 of slight depth may be formed centrally in the outer edge of the sealing strip.

In FIG. 1 the windtight sealing strip 31 is shown installed in its prescribed position between the exterior and interior sill rails 19 and 20 by having its one end immovably secured against the horizontal top surface of the framing member 22 and its opposite end disposed in slidable contact with the horizontal surface. The major portion between both ends of the sealing strip 31 normally bulges upwardly for slidable contact with the bottom horizontal members 16 of the sashes 11.

The reference numeral 37 in FIG. 1 denotes a water outlet opening that may be formed in the exterior sill rail 19 for the drainage therethrough of any water, as of rain, that will collect in the spacing between the exterior and interior sill rails 19 and 20. The windtight sealing strip 31 has a water passageway at 38 so as not to obstruct the drainage of the water through the opening 37.

Thus, for the installation of the sashes 11 into the outer frame 10 from inside the room, which is assumed to be located on the right hand side of the window as seen in FIGS. 2 or 3, the bottom horizontal member 16 of one sash may first be dropped between the exterior and interior sill rails 19 and 20. Thereupon the windtight sealing strip 31 will be pressed flat against the horizontal top surface of the framing member 22 as the said opposite end thereof moves away from the one end in sliding contact with the horizontal surface. The sash may now be raised to receive the exterior header rail 27 in the groove 29 in its top horizontal member 15, and then to receive the exterior sill rail 19 in the groove 30 in its bottom horizontal member 16. The windtight sealing strip 31 regains its original shape by virtue of its own resiliency when the sash is raised away from the framing member 22. It will be apparent from a consideration of FIG. 3 that the other sash can be similarly installed between the interior header and sill rails 28 and 20. Normally, the sealing strip 31 is held in slidable contact with the bottom horizontal members 16 of the sashes 11.

For removal of the sashes 11 from the outer frame 10, the interior sash may first be raised to disengage its bottom horizontal member 16 from the interior sill rail 20. This bottom horizontal member of the interior sash should then be dropped onto the framing member 22 to disengage its top horizontal member 15 from the interior header rail 28. The interior sash is now easily withdrawable into the room. The exterior sash is also removable from the outer frame 10 through an essentially identical procedure.

It will be noted that the manipulation of the sashes 11 into and out of the outer frame 10 is possible from inside the room if the dimension *b*, FIG. 2, of the sill 13 is increased to a desired degree.

A latitude of modification, substitution and change is intended in the foregoing disclosure. It is therefore appropriate that the invention be construed broadly and in a manner consistent with the true spirit and scope of the invention as sought to be expressed in the following claims.

What is claimed is:

1. In a dual sash window assembly of the type comprising an outer frame including a header and a sill, and an exterior and an interior sash installed within said outer frame for independent horizontal movement relative to the same, each of said exterior and interior sashes having an inner frame including top and bottom horizontal members, the combination thereof with an exterior and an interior header rail projecting downwardly from said header and arranged in parallel spaced relationship to each other, an exterior and an interior sill rail projecting upwardly from said sill and arranged in parallel spaced relationship to each other, said top and bottom horizontal members of said exterior sash being adapted to engage said exterior header and sill rails, respectively, so as to be movable therealong, said top and bottom horizontal members of said interior sash being similarly adapted to engage said interior header and sill rails, respectively, so as to be movable therealong, a horizontal surface extending along and formed between the bottom edges of said exterior and interior sill rails, the distance between said horizontal surface and the bottom edges of said header being slightly greater than the height of each said exterior and interior sashes, and a windtight sealing strip of arcuate shape made of resilient material and mounted in a prescribed position between said exterior and interior sill rails, said windtight sealing strip having one end immovably secured against said horizontal surface and the opposite end disposed in slidable contact with said horizontal surface whereby, normally, said windtight sealing strip generally bulges upwardly for slidable contact with said bottom horizontal members of said exterior and interior sashes and wherein said exterior sill rail has an opening adjacent the bottom edge thereof, wherein said interior sill rail has a groove along the bottom edge thereof, said groove opening toward said exterior sill rail, and wherein said windtight sealing strip has a first projection at said one end which is engaged in said opening in said exterior sill rail, a second projection at said one end which is received in said groove in said interior sill rail, and a third projection adjacent said opposite end which is slidably received in said groove in said interior sill rail, said third projection being of smaller dimensions in the longitudinal direction then said second projection.

2. The assembly according to claim 1 wherein said sealing strip is provided with an indentation on the edge where said first projection is located and centrally in said edge, said indentation forming a pair of shoulders which engage with a groove formed in the lower portion of said exterior sill rail.

* * * * *